United States Patent [19]

Smith et al.

[11] 4,155,297

[45] May 22, 1979

[54] SELF-PACKING CONTAINER

[75] Inventors: Fred T. Smith, Palos Verdes Peninsula; George J. Korzeniowski, Sherman Oaks, both of Calif.

[73] Assignee: Sargent Industries, Inc., Los Angeles, Calif.

[21] Appl. No.: 776,946

[22] Filed: Mar. 14, 1977

[51] Int. Cl.[2] ..... B30B 15/14

[52] U.S. Cl. ..... 100/52; 100/53; 100/218; 100/233; 100/289; 414/525

[58] Field of Search ..... 100/53, 233, 289, 256, 100/52, 218; 214/83.3

[56] References Cited

U.S. PATENT DOCUMENTS

| | | | |
|---|---|---|---|
| 3,759,406 | 9/1973 | Nickel | 100/233 |
| 3,881,407 | 5/1975 | Goar | 100/233 |
| 3,942,430 | 3/1976 | Day | 100/52 |
| 3,961,573 | 6/1976 | Schmidt | 100/233 |

FOREIGN PATENT DOCUMENTS 2239396 2/1975 France.

*Primary Examiner*—Billy J. Wilhite
*Attorney, Agent, or Firm*—Ellsworth R. Roston

[57] ABSTRACT

A container in which trash may be stored until such time as the container can be dumped into a truck for transportation to a sanitary disposal site. Trash may be inserted and compacted within the container by a compactor unit formed integrally with or fixedly attached to the container. The compactor unit includes a hopper into which trash may be dumped. A packing panel may be pivotally mounted to move through the hopper to push the trash into the container and compact it therein. The packing panel may move from a position in which the hopper is fully opened to a position in which the panel serves as a door to close the hopper and prevent access to the hopper. The panel can be moved from the "door" position to a third position approximately 180° from the fully opened position. In the third position, the panel has moved all of the trash out of the hopper and into the container. A ball-screw mechanism is provided to drive the panel with a constantly increasing torque as the panel moves from the fully open position to the trash-compacted position. A rim switch may be enclosed within the lip of the hopper so that a very light compression force between the panel and the lip of the hopper will cause the panel movement to be reversed automatically, thereby preventing any possibility of injury to an operator.

30 Claims, 10 Drawing Figures

121
81
41
69
43
51
53
75
65
101
115
33
81
69
71
23
53
111
47
47
47
29
39
187
2a
2a
23
45
35
37

29
187
185

45
75
81
7
33
23
177
175
179
165
41
69
167
91
97
39
187
29
93
65
25
103
105
107
51
101
113
109
115
105
107
111
7
21

SELF-PACKING CONTAINER

BACKGROUND OF THE INVENTION

For many years, industrial plants, office buildings, schools, etc., have employed containers into which trash and garbage may be dumped for temporary storage. Periodically, a sanitation service comes to the location of the container and picks it up by means of a truck-mounted lift mechanism which is normally found at either the front or rear of the truck. In most cases, the trash is rather loosely dumped into the container, for example, when cleaning personnel dump waste baskets, cartons, etc., into the container. Even in those cases where the containers are used at construction job sites or other industrial applications, they are usually rather loosely filled since, in most cases, no provision is made for compacting the trash within the container to eliminate otherwise unused space between the loosely packed trash.

Containers of this type require a relatively low initial capital expenditure, but are relatively expensive across their useful lifespan. This is because a loosely packed container must be dumped at rather frequent intervals in order to keep the trash from overflowing which results in unsightliness, littering, and rodent infestation. In other words, overall use of these containers is relatively expensive since a truck operated by one or more men must be brought to the container location to empty the container at relatively frequent intervals.

Some prior art devices have attempted to eliminate this deficiency by providing containers which may be used in combination with moveable packing members which can be removeably attached to a number of containers sequentially, allowing each container to be packed at least at periodic intervals. However, while this does decrease the number of trips which must be made by a disposal truck to dump the containers, it is also a cumbersome and expensive operation since it requires at least one employee to either move the containers to the compacting device or else to move the compacting device to the containers. Further, containers of this type must be provided with special doors and related hardware to accommodate the packer device while preventing the trash from falling out of the container at the opening through which the compactor must extend. This creates the additional problem of allowing rodent infestation of the container if any damage to it occurs which might warp the door, etc.

Recently, a partial solution to some of these problems has come about through the utilization of a power actuated packer which is integrally mounted within such container. An example of such a device has been illustrated in U.S. Pat. No. 3,709,389 to Steltz. That patentee has disclosed the combination of a trash container of fairly standard size and shape but with doors at one side of the container. Trash may be deposited in the container through the side doors and an hydraulic cylinder may be actuated to pivot a compactor through the trash-receiving portion of the container toward the opposite wall of the container. In this manner, some of the otherwise unused space within the container will be eliminated and more trash can be stored until such time as the container can be emptied. When it is desired to empty the container, a door on the top of the container near the end opposite the trash-receiving doors may be opened and the container may be lifted and dumped into a removal truck.

As stated previously, this prior art device only partially solves the problems ennumerated above for a number of reasons. First, a separate set of doors must be provided for access to the trash-receiving portion of the container, thereby increasing the complexity of the device as well as the possiblity of trash spillage, rodent infestation, etc. Secondly, that apparatus discloses a compactor operating mechanism mounted within the trash container. In an attempt to eliminate the possibility of trash getting into the drive mechanism, that patentee has recognized the necessity of providing extra structural elements, thereby diminishing the amount of space within the container.

It has become imperative that these problems be solved due to increasing costs of trash disposal and ecological awareness. In other words, the need for a solution to the old problem of storing trash at its point of origin in a manner which is clean, safe, and economical is becoming more and more pressing as the population grows and individual trash generation increases.

It has also proven to be desirable to provide a mechanism which solves these problems which, though simple and inexpensive, will allow a gradually increasing force to be exerted along the path of the trash compactor as the operation is undertaken. In other words, when trash is initially being compacted, it is normally relatively easy to push it with a compactor. For example, if cartons are inserted into the trash-receiving portion of a container, it should be rather easy for a compactor mechanism to crush the cartons in order to eliminate the waste spaces in them. On the other hand, when this has been accomplished, it becomes necessary to ensure that the cartons are packed tightly against one another with a minimum of excess space between cartons. At this point, it is preferred that the compaction force be increased to accomplish the extra packing. Until the discovery of the present invention, these results had not been achievable with any prior art structures.

SUMMARY OF THE INVENTION

The present invention relates to a trash container employing a packing structure which may be integrally mounted upon or fixed to a stationary container. However, the present invention may be embodied in structure which totally eliminates the prior art deficiencies described above. For example, the person dumping trash into the container can open and close it and compact the trash by operating a single switch.

Briefly described, the present invention may be embodied in a stationary container having a trash-receiving portion and a trash-storage portion. The trash-storage portion of the container may be substantially enclosed on all sides and may be provided with a trash-removal door on the top or a wall thereof. One wall of the storage container may be provided with an opening in communication with a trash-receiving portion of the container. This latter portion may comprise a bin or hopper having a curved bottom which extends from a bin lip or rim to the opening in the storage portion. On the wall of the container which includes the opening, a door or packer panel may be pivotally mounted for movement through an arc of approximately 180°. The door may cooperate with the lip or rim to close the bin and may be pivoted to move closely along the curved bottom of the bin and at least partially into the opening which leads to the storage portion. Thus, the door serves the dual function of closing the bin with respect to the exterior of the container and compacting any trash dumped into the bin. Since the door is pivotally mounted, it may be withdrawn from the position in which it closes the bin to a location approximately 180° from the maximum compaction position, thereby totally eliminating any possibility of the door interfering with an operator dumping trash into the container.

When the door is fully opened, it is well away from the position is which it can push trash in the bin into the container and compact it. Consequently, there is very little need for imposing a large torque on the door when it is moving from the fully open position to the bin-closed position. On the other hand, when the door moves from the bin-closed position through the bin to the fully compacted position, the further the door travels the more force it must apply to insure the efficient use of the compaction apparatus.

Accordingly, the preferred embodiment of the present invention may utilize a drive system which imposes relatively small torque to move the door from the fully open to the bin-closed position and imposes a gradually increasing torque on the door panel as it moves from the bin-closed to the fully compacted position. Further, in the preferred embodiment, the drive structure may be a relatively simple and compact mechanism which may be mounted in a small compartment or cabinet immediately next to, but outside of, the trash bin and storage compartments.

In this preferred embodiment, the door may be pivotally mounted on a torsion tube which is rotated about its axis by a torque delivery arm or lever which is moved by the drive mechanism. The drive mechanism may comprise a ball gear, pivotally mounted in the torque arm which cooperates with a screw gear. The screw gear and its drive motor may be pivotally mounted on the container frame in such a way that movement of the ball gear down the screw toward the motor will cause the lever arm, i.e., the distance between the axis of the screw gear and the axis of the torsion tube, to continuously increase, thereby continuously increasing torque imposed on the door-panel.

A novel control system may be employed with this preferred embodiment which will generally cause the door-panel to seek out the bin-closed position. Thus, when the door is actuated to compact the trash, and a predetermined maximum force has been imposed, the direction of travel of the door will be automatically reversed and the door will return to the bin-closed position.

On the other hand, in order to prevent injury which might possibly occur if an operator has his hand on the lip of the bin, a rim switch may be provided on that lip which will cause the door to immediately and automatically reverse to the fully open position if any pressure on the lip is sensed by the rim switch. By use of this same structure, injuries and damage which might otherwise occur from flying sticks, glass, etc., if the trash is not completely pushed into the container before the door is actuated to the binclosed position, will be eliminated. As the door moves from the fully open to the bin-closed position, any trash in the bin extending beyond the lip will be pushed against the rim switch by the door, causing the door to automatically reverse to the fully open position. Thus, the device will prevent injury and/or damage which might occur from flying debris generated by trash pinched between the door and the rim.

These and many of the other objects and advantages of the present invention will become readily apparent to those skilled in the art upon perusal of the following detailed description, taken together with the accompanying drawings.

DETAILED DESCRIPTION

Figure 1:
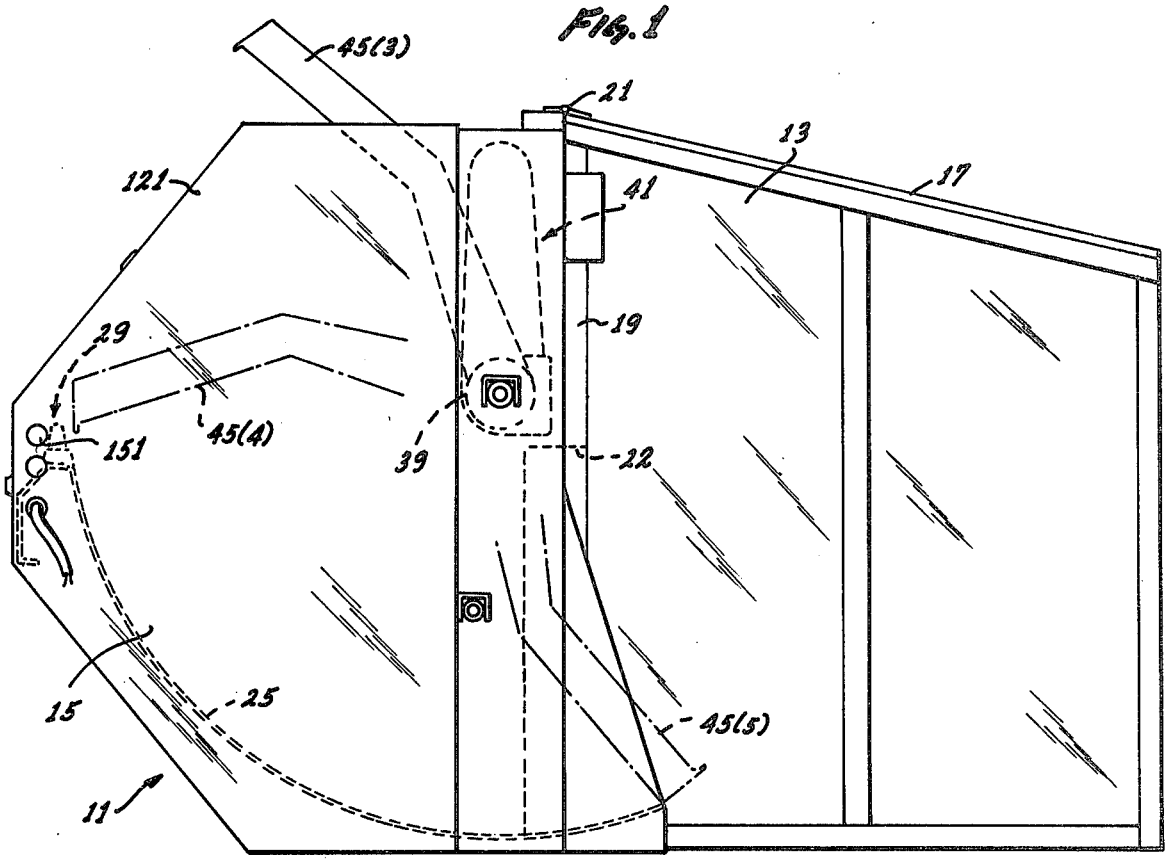
FIG. 1 is a side elevation of a trash container which may be formed in accordance with the present invention, schematically illustrating the three major positions of a bin door-trash compacting panel.

In FIG. 1, there is shown a trash container generally designated 11 comprising a storage section 13 and a receiving section 15. The storage section basically is a hollow boxlike member manufactured from steel or other suitable pressure-resistant material and may have a dump door 17 which may, for example, be located on the top thereof and pivotally mounted on a back wall 19 by means of a hinge 21. In this particular embodiment, the back wall 19 may be provided with an opening 22 within the bottom half thereof through which trash may be inserted into section 13.

Figure 2:
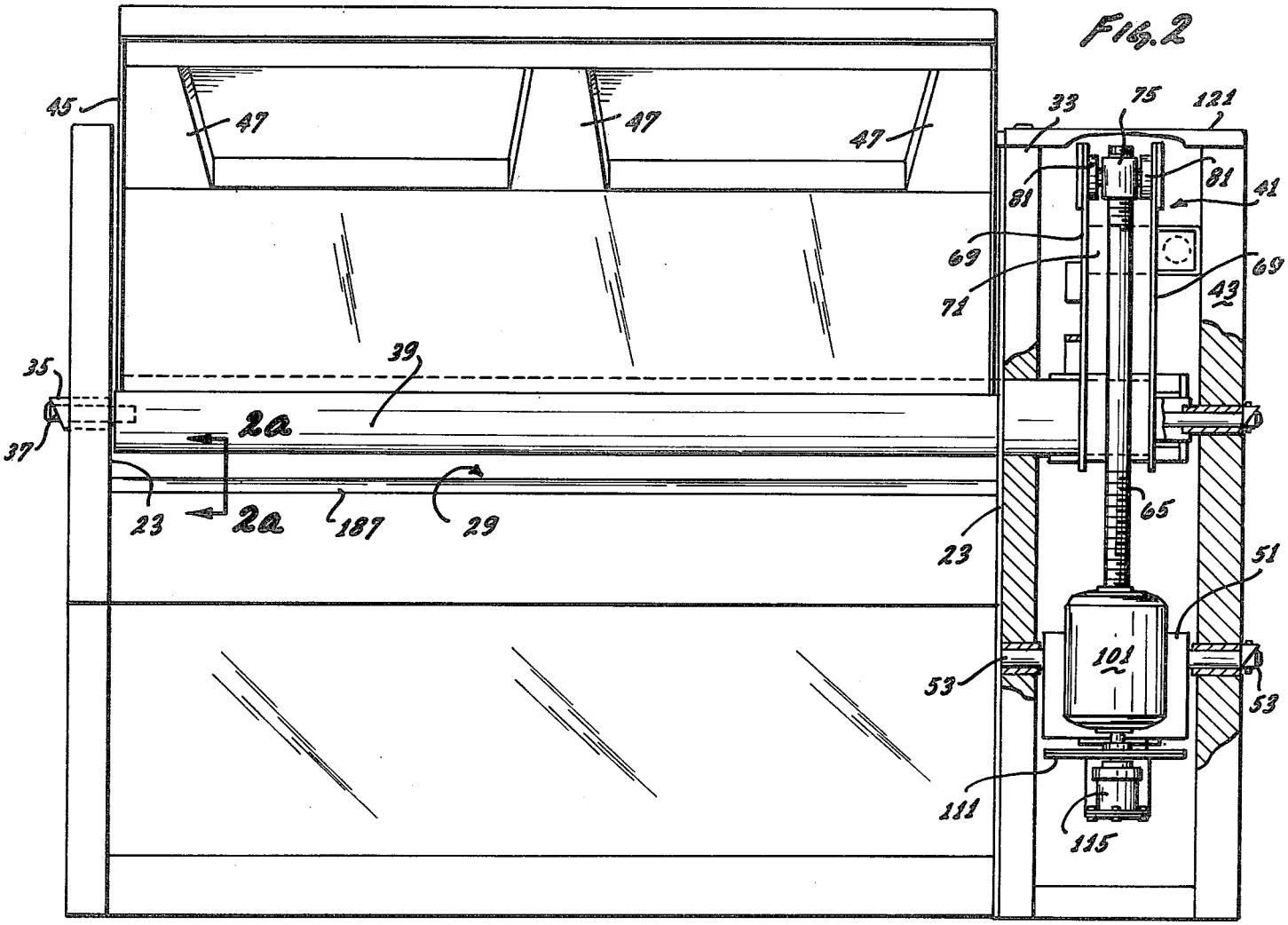
FIG. 2 is an end elevation of the structure shown in FIG. 1, as seen from the left side of the drawing, partly in section to illustrate certain features of the drive system.
Figure 2A:
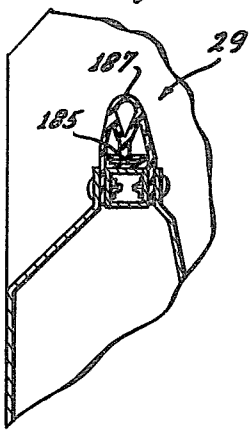
FIG. 2A is a sectional view of the lip of the trash-receiving container as seen along a line *2a—2a* in FIG. 2.
Figure 3:
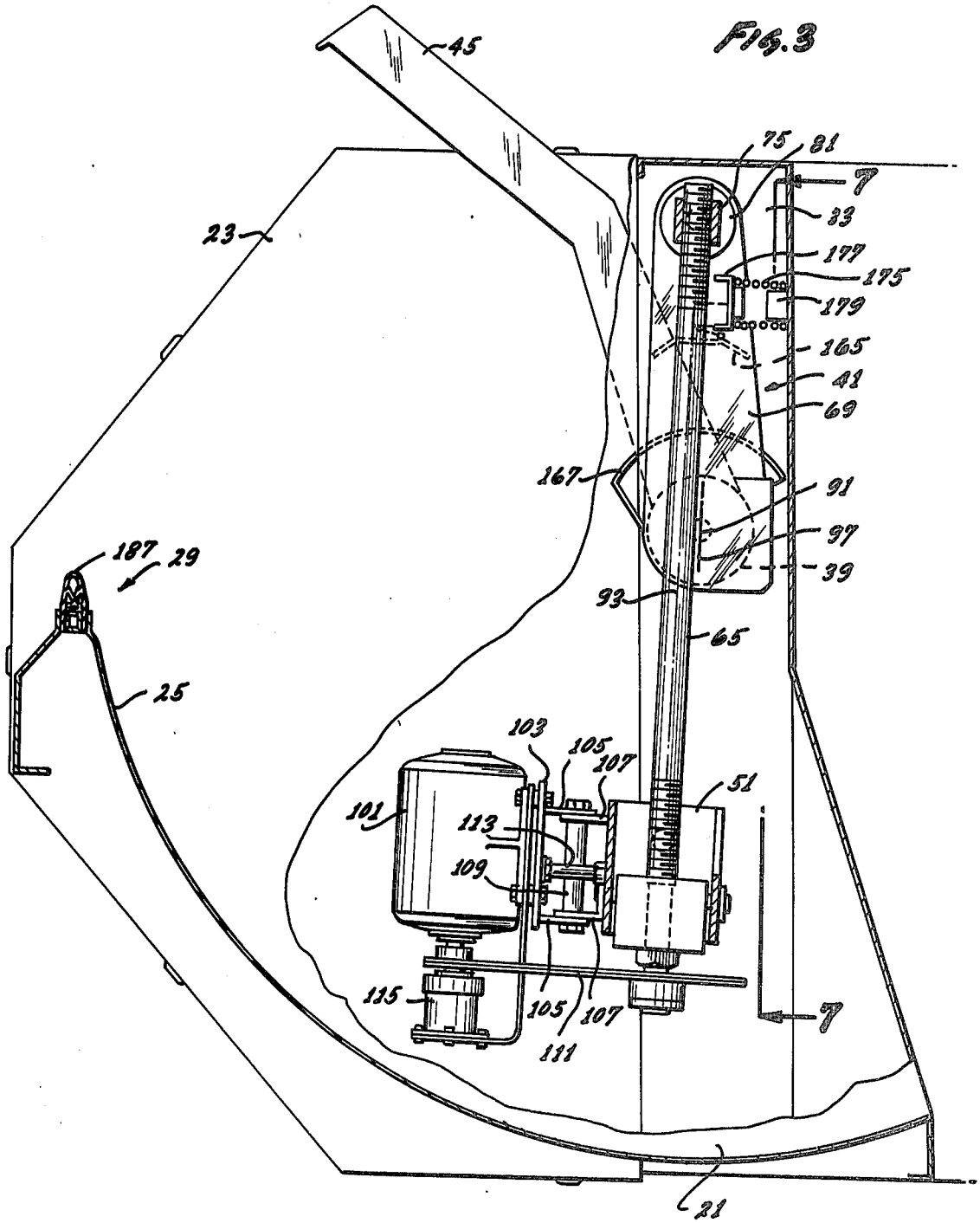
FIG. 3 is a side, sectional view, with various parts broken away for the sake of clarity, of the trash-receiving bin or hopper of the refuse container and the drive system with the door in the fully open position.

Referring now to FIGS. 1-3 together, the trash-receiving bin or hopper portion 15 of the device may be formed integral with or otherwise fixedly attached to the storage compartment 13 and may comprise a pair of sidewalls 23 which are joined together across the bottom of the bin by a curved bottom surface or wall 25 which extends between the lip 29 and the opening 22 into the storage compartment. The exterior of the bin portion 15 of the container 11 may be provided with any desired structural support members, such as steel plate. As shown in FIG. 2, at either side of the bin and near the junction of the bin 15 and container 13, a pair of upright supports 31 and 33 may be provided. The support 31 may be provided with a bearing 35 for rotatably receiving a pin 37 which may be fixed to or integrally formed with a torque transmitting means 39. Alternatively, the pin 37 may be fixed in the upright support 31 and journaled within the end of the torque transmission means 39 in any well known manner.

The torque transmission means 39 may be formed from any suitable structure, such as a ½ inch wall steel tubing. In any event, the other end of the torque transmitter 39 may be pivotably supported relative to support 33 and suitably attached to a torque lever or arm 41 in any desired manner, such as by welding.

The end of the torque transmitter 39 adjacent the torque arm 41 may be suitably mounted for rotation relative to an end support 43 in substantially the same manner as it is mounted in the end support 31. Thus, movement of the torque lever 41 will cause the transmitter or torque tube 39 to rotate about its axis. A door-panel 45, having suitable strengthener sections 47, may be fixedly attached to the torque tube 39 by any suitable means, such as welding. Thus, as the torque tube is rotated about its axis, the panel 45 will be rotated between the positions shown in FIGS. 3 and 5 through the position shown in FIG. 4.

Figure 4:
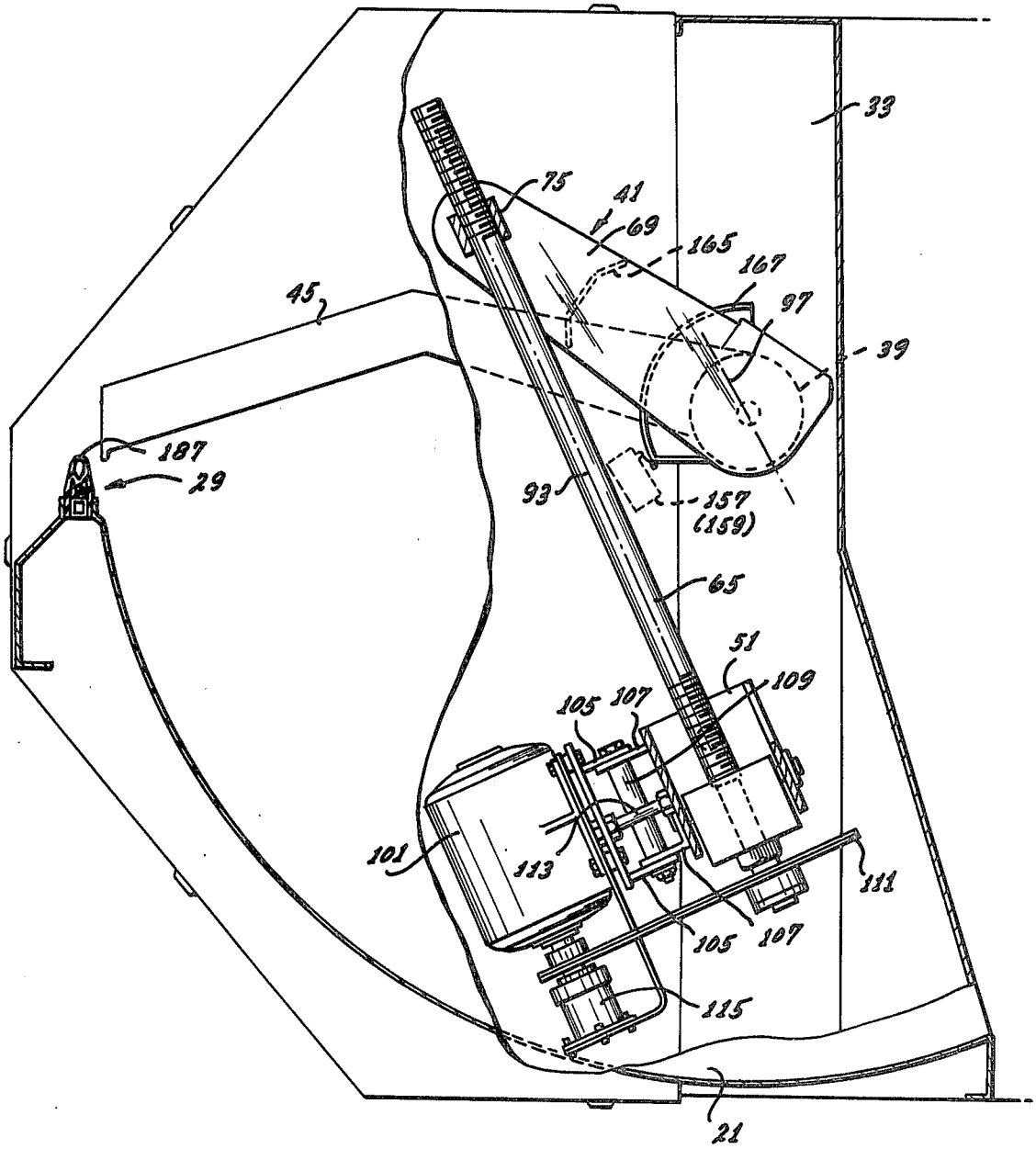
FIG. 4 is a view similar to FIG. 3, showing the relationship of the various structures with the door in the bin-closed position.
Figure 5:
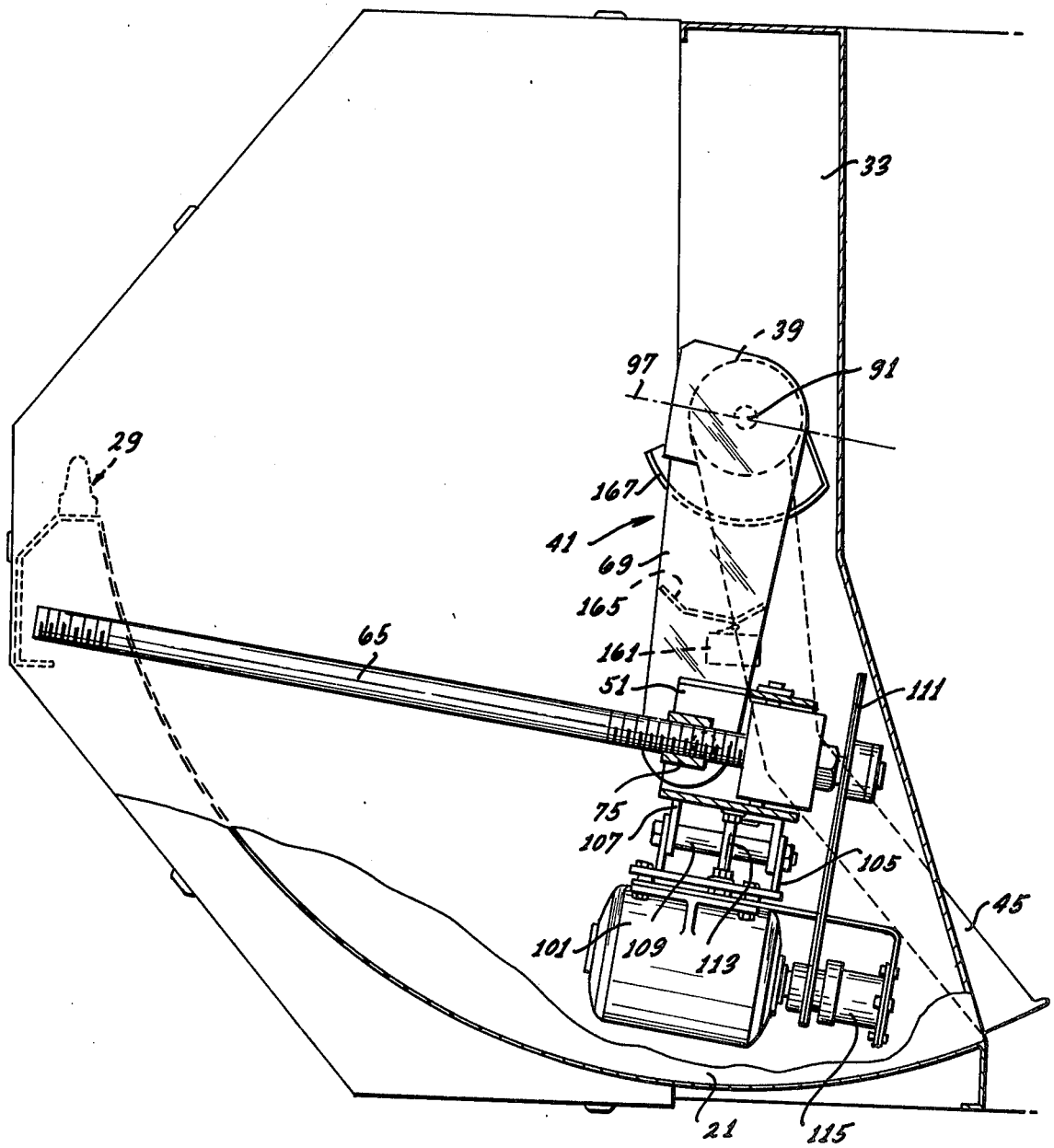
FIG. 5 is a view similar to FIGS. 3 and 4, with the door-panel in the fully compacted position.

Thus, all three of the major positions of the door-panel 45 have been illustrated in FIG. 1 with the corresponding FIGS. 3, 4, and 5 set forth in parentheses with each identification numeral.

Figure 7:
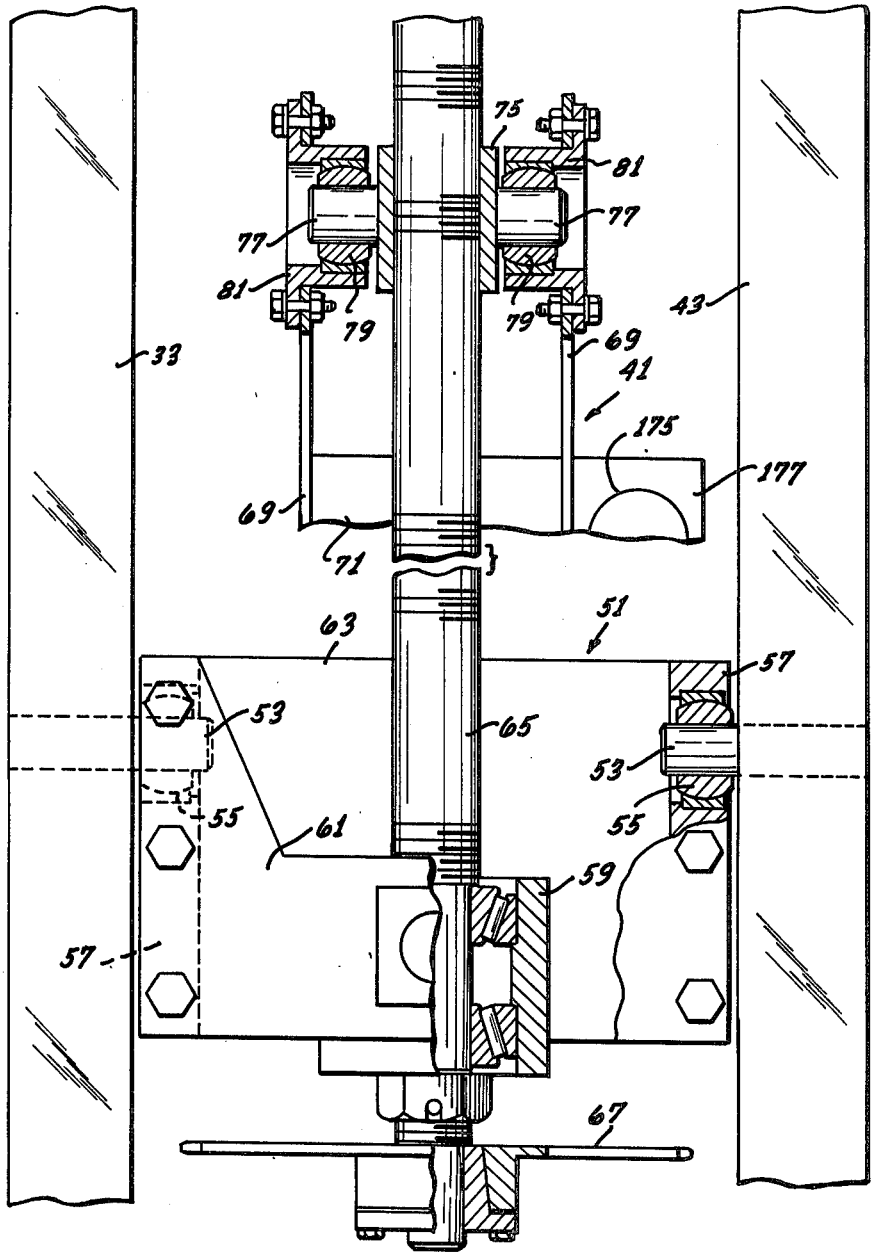
FIG. 7 is an elevation of the drive structure, as seen along a line 7—7 of FIG. 3.

As shown particularly in FIGS. 2 and 7, a bracket 51 may be pivotally mounted on the supports 33 and 43 by means of a pair of coaxially aligned shafts 53 which may be journeled within bearings 55 in the sides 57 of the bracket or within the supports. An axial support bearing 59 may be trunion mounted between the front wall 61 and the rear wall 63 of the bracket in order to support a rotatable screw gear 65. To the lower end of the screw gear 65, a sprocket 67 may be attached in order to cause rotation of fhe screw gear in a manner to be described below.

As seen particularly in FIG. 7, the torque lever 41 comprises a pair of parallel plates 69 joined together by any suitable means such as a channel member 71 which may be utilized to structurally rigidify the lever. Near the upper end of the lever, a gear 75, commonly known as a "ball gear," may be mounted on the screw gear 65 for axial movement along the screw gear as the latter is rotated. Such axial movement can be ensured by fixing the ball gear to trunions 77 which are mounted in bearings 79 for rotation relative to brackets 81 which may be fixedly attached to the arms 69 of the torque lever 41. Thus, since the ball gear 75 is prevented from rotating about its own axis, rotation of the screw gear 65 about its axis will cause the ball gear 75 to translate along the axis of the screw gear. Since the ball gear 75 is fixed relative to the outer end of the torque lever 41, when the screw gear is rotated the ball gear will move lever 41 about the axis of torque transmitter 39. Considering FIGS. 3–5 for example, it can be seen that when the screw gear 65 is rotated in one direction, the ball gear 75 will move from the upper end of the screw gear toward the bottom end and, when the screw gear is rotated in the opposite direction, the ball gear will move toward the upper end. As can be seen from those three Figures, this action will cause the torque lever 41 to rotate about the axis 91 of the torque tube 39, moving the panel-door 45 accordingly. Since the bracket 51 is pivotally mounted on the trunions 53, this movement will not be inhibited since the axis of the screw gear 65 can be moved so as to pivot in the manner illustrated in those Figures.

This perculiar relationship of structure as illustrated in the preferred embodiment produces the valuable result of applying only a relatively small torque when little or no work is needed, while applying a large torque when much work is needed. Utilizing the principle that a lever arm, when calculating moment and torque, is equal to the distance between the point of application of force and the axis of rotation, measured along a line perpendicular to the axis of rotation and parallel to the line of action of the force, the present invention allows this gradually changing torque to occur. Considering FIG. 3, for example, it can be seen that the axis 93 of screw gear 65 is rather close to the axis of rotation 91 of the torsion transmittor 39. Thus, if we imagine that a line 97 is drawn perpendicular to the axis 91 and parallel to the axis 93, the distance between the line 97 and the axis 93 is rather small. Thus, the moment of the force, or torque, applied to the torque lever 41 is rather small when the door-panel 45 is in the fully open position. Next, considering FIG. 4, it can be seen that the distance between the imaginary parallel line 97 and the axis 93 is now much greater than it was when the door was in the fully open position. However, it can also be seen that the distance of ball gear 75 has traveled down the length of the screw gear 65 is rather small. In other words, for a very short distance of relative travel of the screw and ball gear, the amount of torque being applied to the panel has increased from nearly a minimal amount to a small or moderate amount. Now, comparing FIGS. 4 and 5, it can be seen that the distance between the imaginary parallel line 97 and the axis 65 is at a maximum in FIG. 5 since they are as far apart as the dimensions of the torque lever 41 will allow. Thus, when the door-panel 45 is in the fully compacted position, the lever arm of the moment of force or torque being applied to the panel is at a maximum. Similarly, it will be realized that this increase in the lever arm is generated across a much larger relative movement between the ball gear 75 and the screw gear 65.

Consequently, when the door is moved from a fully opened position (FIG. 3) to the door closed position (FIG. 4) a relatively small amount of torque is imposed. This is quite acceptable, however, since any trash which might extend above the lip 29 of the bin will not require a great deal of compaction to allow the door to reach the closed position shown in FIG. 4. On the other hand, as the door moves from the closed position towards the fully compacted position, more and more force will have to be imposed upon the trash to continue the compaction and force it into the container while recompacting the trash in the container as the new load is forced against it. Due to the novel relationship of this structure, this result is now available, for example, in the manner shown in the preferred embodiment, in a very simple and compact structure.

As shown in FIG. 3, a motor 101 may be fixedly mounted on a bracket 103. A pair of arms 105 may be mounted on the bracket 103 for close planer cooperation with a similar pair of arms 107 which are attached to the bracket 51. Any suitable pivot means, such as a bolt 109, may be utilized to connect the arms 105 and 107 so that the bracket 103 may be pivotally mounted relative to the bracket 51. The motor 101 may drive a sprocket (not shown) which, in turn, will deliver power to a chain or belt 111 to drive the sprocket 67 on the lower end of the screw gear 65. In order to properly tension the force transmittal device 111, a threaded bar 113 may extend between the brackets 51 and 103. If the pivot pin 109 and the bar 113 are near the opposite edges of the brackets 103, the provision of nuts or other suitable means on the rod 113 which will bear against the brackets 51 and 103 will allow them to be provided about the pin 109, thereby adjusting the tension on the belt 111. If desired, a brake 115 of electrical or mechanical nature may be provided on the shaft of the motor 101 in order to stop the motor at once when power is shut off.

As can be seen in FIG. 2, the very simple drive structure of the preferred embodiment of this invention may be mounted in a relatively narrow compartment or cabinet-like structure which may, for example, be enclosed by a cover 121 which is shown in place in FIG. 1. Thus, it is impossible for any trash to get into the drive structure and foul it and thus damage the machine and require unnecessary maintenance.

Figure 6:
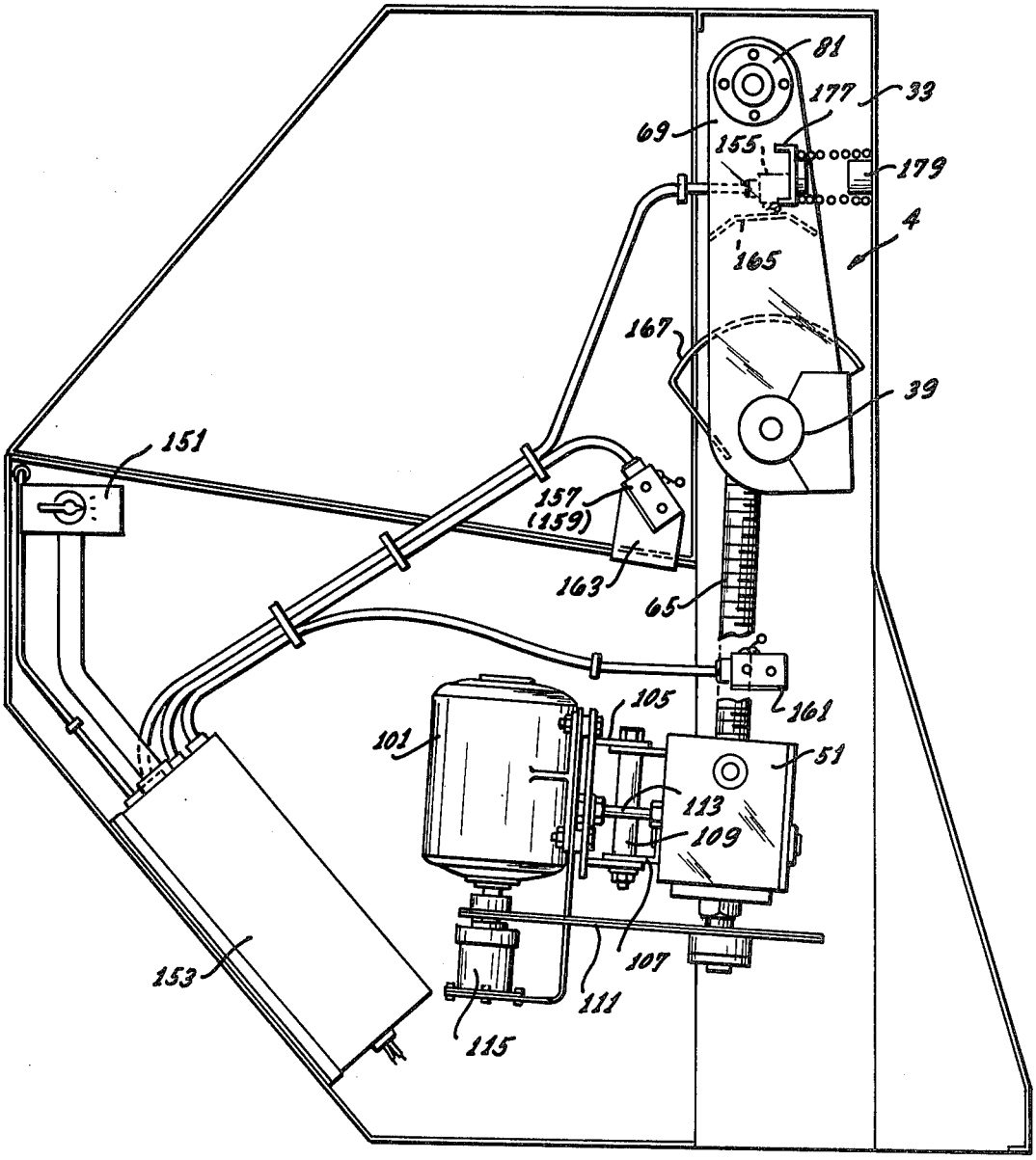
FIG. 6 is a side view of the control system, illustrating various electro-mechanical structures utilized to control the operation of the door panel.

In order to control the machine, an operator may actuate a key- or lever-controlled switch 151 (FIGS. 1 and 6) which delivers a control signal to an electric circuit contained within a circuit box 153. Connected to the control circuit 153 for reasons to be disclosed below, are a plurality of limit switches 155, 157, 159, and 161. Limit switches 157 and 159 are mounted adjacent one another on a support 163 in such a manner that only one of the switches can actually be seen in FIG. 6. For the sake of this description, however, it will be presumed that limit switch 157 is a normally open limit switch and limit switch 159 is a normally closed limit switch.

A pair of cam actuators 165 and 167 may be mounted between the plates 69 of the lever 41 for actuation of the limit switches. Thus, when the door is in the fully open position shown in FIG. 3, cam 165 will actuate limit switch 155 to open the circuit in a manner to be described, shutting off the motor 101 and stopping further movement of the door 45.

As the door moves slightly past the position shown in FIG. 4, toward that shown in FIG. 5, limit switch 157 will be actuated by the cam 167, thereby closing the switch and maintaining power to the motor 101 to allow the door to be driven from the closed to the fully compacted position. Switch 159 will also be actuated by cam 167 for a purpose to be described below. As the door reaches the fully compacted position, cam 165 will actuate limit switch 161, thereby reversing the direction of rotation of the motor 101 and causing the door to be moved back toward the position shown in FIG. 4. When the door reaches the position shown in FIG. 4, cam 167 will end its contact with limit switches 157 and 159, causing the switches to resume their normally opened and closed positions, respectively, and the opening of switch 157 will shut off power to the motor 101.

Thus, in order to operate the preferred embodiment, when it is desired to open the door 45 to the position shown in FIG. 3, the person dumping trash will actuate the switch 151 to move the door toward that position. As long as he manually maintains the switch in the actuated position, the door 45 will continue to open until such time as the switch 155 is actuated by cam 165. Since the torque being exerted on the door is a minimum at that point in its travel, a coil spring 175 which may, for example, be mounted on a channel member 177 on the torque lever 41, may cooperate with a mandrel 179 which is fixed relative to the supports 33 and 43 to aid in stopping movement of the door. When the operator desires to move the door from the position shown in FIG. 3 to that shown in FIG. 4, he may actuate the switch 151 in the opposite direction. Spring 175 will then aid in starting the movement of the torque lever 41, and thus the door 45, and as long as the switch 151 is manually actuated, the door will continue to move. When the operator has brought the door down to the fully closed position shown in FIG. 4, if he desires to compact trash in the bin 15 and push it into the container 13, he may continue the manual actuation of the switch 151 for just a moment longer. If he does so, the cam 167 will actuate the switches 157 and 159 and the operator can release the switch 151. The door will move downwardly to the fully compacted position until the switch 161 is actuated by the cam 165, automatically returning the door to the position shown in FIG. 4 as described previously. Thus, the operator can initiate the compacting action and walk away from the machine, knowing that the door will return to the closed position and that children, rodents, etc., will not be able to get into the bin and hurt themselves. This is particularly true if switch 151 must be actuated by a key.

At times, it is possible that trash dumped into the bin 15 may not be pushed completely into the bin and may extend across the lip 29. Under such circumstances, the trash could be pinched between the lip 29 and the door 45. If that should occur, it is possible that any solid matter in the trash would suddenly be broken and become a very dangerous missile. Also, it is possible that the operator may, inadvertently, leave his hand on the lip 29 while he is actuating the door 45 to the closed position. In such an instance, the door 45 could pinch his hand against the lip 29 and injure it.

In order to prevent such occurrences however, the lip 29 may be provided with a normally open switch 185 which may be actuated by the imposition of a very light pressure on a flexible element 187 extending across the entire length of the lip 29. Thus, if any trash or a part of the operator's hand or body should be resting against the flexible element 187, a slight amount of pressure, such as might be imposed by the door 45 as it is traveling from the fully open to the closed position, will automatically reverse the electrical circuit and return the door to the fully open position. If this should occur, the door will return to the fully open position until the limit switch 155 is actuated by the cam 165, even though the operator may not be actuating the switch 151.

Figure 8:
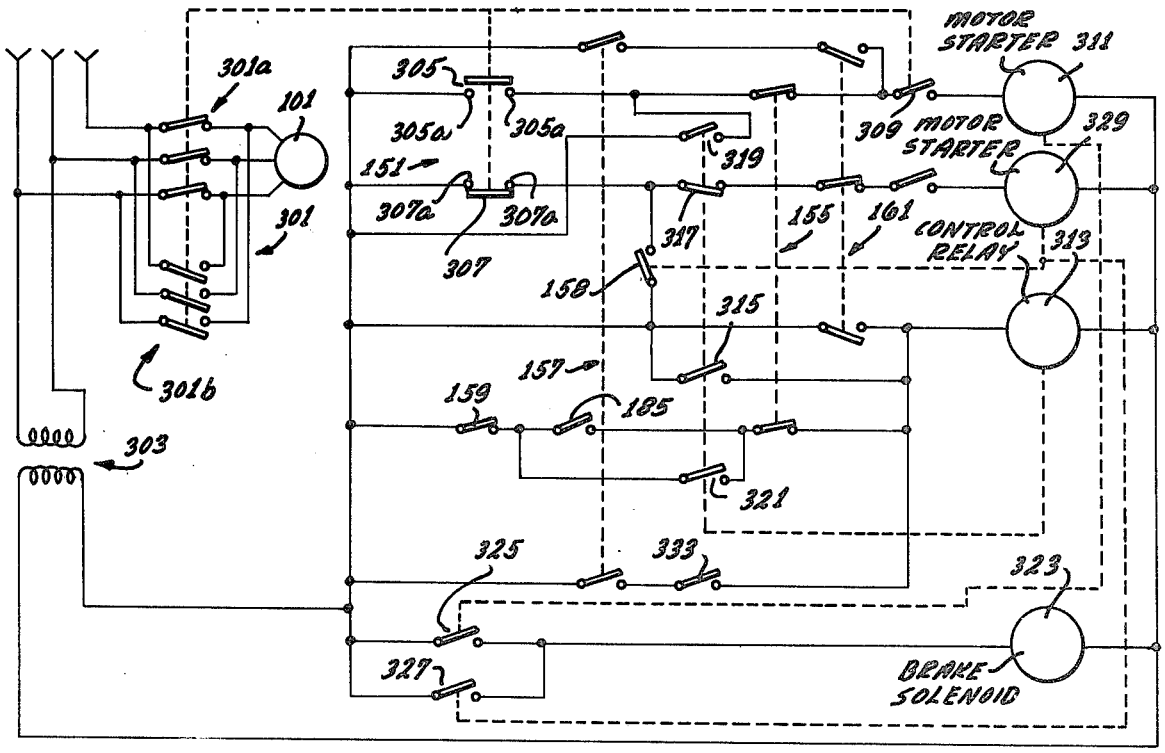
FIG. 8 comprises a schematic of an electrical control system which may be utilized in accordance with the preferred embodiment of the invention.

In order to more completely understand the operation of the electrical portion of the structure of the preferred embodiment, there is shown in FIG. 8 a presently preferred embodiment of a control circuit for the operation of the packing head-door 45. As shown, the circuit may be provided with a standard reversing switch 301 having a plurality of contacts **301*a* for operation of the motor 101 in a first direction and a second plurality of contacts 301*b* for operation of the motor 101** in a second direction.

If desired, there may also be a control power transformer 303 which may be used to reduce the voltage to a lower level for operation of the main portion of the control circuit.

The selector switch 151 may comprise a pair of contactors 305 and 307 which cooperate with respective contacts **305*a* and 307*a*. When the operator turns the selector switch 151 to the position causing the door 45 to open, contactor 305 cooperates with contacts 305*a* to cause the motor 101 to be driven in the proper direction through the contacts formed by normally closed limit switch 155, a normally closed switch 309 (which actuates the reversing switch contacts 301*b*) and a motor starter 311. If the operator should release the selector switch before the panel is completely opened, contactor 305 will become separated from contacts 305*a* and movement of the panel will immediately stop. On the other hand, if the operator keeps the switch 151 closed until the panel is completely opened, limit switch 155 will ultimately be opened due to its cooperation with the actuator 165, thereby causing the circuit to be broken and the motor 101** to be stopped.

When the operator turns the selector switch 151 to close the door 45, the contactor 307 will cooperate with contacts 307*a* to close a circuit as long as the operator holds the contactor in that position. When the contactor 307 engages the contacts 307*a*, the motor starter 329 is energized and motor 101 turns in the opposite direction from that described above until the door 45 is located in the closed position shown in FIG. 4. At a position slightly beyond that point, the normally open limit switch 157 will be closed by the cam actuator 167. The operator may then release the selector switch 151 since the motor starter 329 will be energized through a circuit including a switch 158 which is closed when the motor starter 329 is actuated. This will cause power to be provided to the motor 101 to obtain a continued movement of the door-packer panel 45 to the position shown in FIG. 5.

When the fully compacted position shown in FIG. 5 is reached, limit switch 161 will be opened by the cam actuator 165, breaking the circuit through the motor starter 329 and stopping further packing movement of the panel. When limit switch 161 is actuated, a second set of contacts within the switch will be closed. Since the switches 157 and 161 have been actuated, the motor starter 311 will be energized and the current delivered to the motor will be reversed, thereby causing the motor to withdraw the panel 45 from the position of FIG. 5 back to the position of FIG. 4. Since the limit switches 157 and 161 are actuated, a control relay 313 is energized through these switches. This causes a set of contacts 315 to be actuated. This in turn establishes a continuous circuit through the control relay 313 even though the cam actuator 165 moves away from the limit switch 161, thereby causing the latter's second set of contacts to open. As the panel returns to the position shown in FIG. 4, the limit switch 157 will return to its normally open position because the cam actuator 167 will no longer be in contact with the switch. When this happens, the circuit will be broken and movement of the panel will stop.

When the panel is between the positions illustrated in FIGS. 3 and 4, the normally closed limit switch 159 will cause current to be delivered to the rim switch 185. If pressure is exerted on the flexible element 187 on lip 29, causing the rim switch 185 to be closed, current will flow through the normally closed limit switch 159 and the switch 185 to the control relay 313 which will open a pair of normally closed contacts 317 and close a pair of normally open contacts 319, causing the motor to reverse and withdraw the panel back to the position shown in FIG. 3. When the control relay 313 is energized, a pair of contacts 321 are also closed to maintain the relay energized. This will in turn cause a holding circuit to be established through the control relay 313 so that the contacts 317 will remain open and the contacts 319 will remain closed. Thus, the motor starter 311 will remain energized so that the door 45 will continue to return to the fully open position even though pressure on the lip 29 may cease. When the door-panel 45 returns to the fully open position, limit switch 155 will be opened by the cam actuator 165 and the motor will be stopped.

On the other hand, if no obstruction is encountered by the door 45 during movement from the position shown in FIG. 3 to the position shown in FIG. 4 and the door-panel has achieved the position shown in FIG. 4, limit switch 159 will be opened by the cam actuator. Subsequently, even if pressure should be exerted on the lip 29 to close the rim switch 185, the circuit to the control relay 313 cannot be completed to return the door panel to the position shown in FIG. 3 since the limit switch 159 will be open.

Whenever the motor is stopped, whether to stop or reverse the movement of door 45, it is preferred that stopping be complete and instantaneous. Accordingly, a brake solenoid 323 is actuated whenever contacts 325 are closed by operation of the motor starter 311 or contacts 327 are closed by operation of the motor starter 329. When the brake solenoid 323 is energized, the brake 115 is moved from an operative position providing a braking action on the shaft of the motor 101. However, when the motor starters 311 and 329 are no longer energized, the brake solenoid 323 is also no longer energized. This releases the brake 115 for movement promptly against the shaft of the motor 101.

When limit switch 157 is closed by cooperation with the cam actuator 167, it also cooperates with a set of contacts 333 to provide for a delivery of power to the control relay 313. If the back pressure on the refuse or trash being compacted increases a sufficient amount to cause an overloading of the current being delivered to the motor 101, the instantaneous current relay contacts 333 will be closed, causing the control relay 313 to become energized and reverse the normal positions of the various contacts 315, 317, 319 and 321. When this occurs, the compaction operation will be terminated automatically in the manner described above even though the limit switch 161 has not been activated. When this occurs, the panel will again return to the position illustrated in FIG. 4.

Of course, while the above-described control circuit is the presently preferred embodiment, those skilled in the art will realize that it is merely exemplary. Many modifications may be made without significantly changing the desired results.

Figure 9:
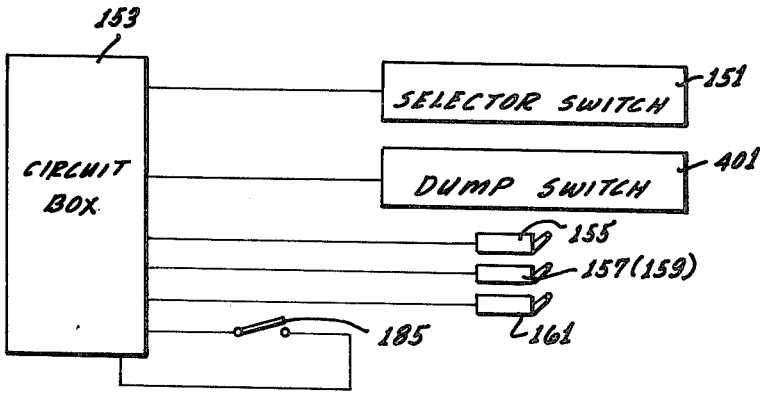
FIG. 9 is a line diagram schematic of an alternate embodiment of the present invention.

A modified embodiment of the control structure illustrated in FIG. 8 has been shown in FIG. 9 wherein those elements which are identical to those shown in FIG. 8 have been provided with similar identification numerals and will not be described again.

In some instances, when it is desired to dump the container into a truck so as to take the trash to a disposal site, it may be desirable to utilize the operation of the door-panel 45 to push the trash when the door 17 of the container is opened and the container is inverted over the truck. In such cases, it may be necessary to prevent the actuations of the instantaneous current relay 333, thereby providing the removal personnel with the option of providing slightly more power to the panel when dumping but preventing the people who dump trash into the bin 15 from utilizing that power. In such a case, a key-actuated dump switch 401 may be provided which may be utilized to bypass both selector switch 151 and the instantaneous current relay 333, thereby providing a selective time during which extraordinary current may be delivered to the motor to power the panel 45. It is noted that in many instances this device and its use may not be required. However, even when it is required, the possibility of damage to the motor or other control circuitry is minimized since the door 17 of the container 13 will normally be open under such circumstances. Since the trash will be free to fall out of the opened door 17 and into the removal truck, the possibility of a sufficient backpressure being exerted on the panel by the trash to cause any damage to the machinery will be eliminated.

Having now studied the above description and the accompanying drawings, those skilled in the art will be aware of the fact that this invention is not limited to the preferred embodiment described above. In fact, the invention may be employed in a wide variety of embodiments, many of which may not even seem to physically resemble that depicted in the drawings. However, the measure of the present invention shall be determined by the following claims and shall not be deemed to be limited by the preferred embodiment.

We claim:

1. A trash storage apparatus comprising
a storage bin for receiving and holding trash,
a receiving bin adjacent to and in communication with said storage bin,
means for selectively closing said receiving bin and for pushing trash in said receiving bin into said storage bin, said closing and pushing means being movable between a position in which said receiving bin is closed and a position in which said closing and pushing means is positioned at the location in which said receiving bin and said storage bin are in communication,
drive means, and
means operatively coupled to the drive means and the closing and pushing means for coupling the drive means to the closing and pushing means to produce a movement of the closing and pushing means with decreasing speed and progressively increasing force from the closed position to the position in which said receiving bin and storage bin are in communication.

2. A trash compaction device comprising
a trash-receiving bin,
storage means disposed in contiguous relationship with the bin and communicating with the bin for the transfer of refuse from the bin to the storage means,
compaction panel means mounted on said bin and movable between
a first position in which said panel means is elevated above said receiving means to provide for placement of trash into said receiving means,
a second position in which said receiving bin is closed and no trash can be placed therein, and
a third position in which any trash placed into said receiving bin is pushed toward and compacted within the storage means, and
means for moving said panel means from said first position to said second position at a relatively high speed and with a relatively low force and from said second position to said third position with progressively increasing force and progressively decreasing speed.

3. The device of claim 2 including
means for sensing when said panel means is in said third position and for returning said panel means to said second position.

4. The device of claim 2 including
means for sensing that trash in said storage means is fully compacted and for returning said panel means to said second position before it reaches said third position.

5. A machine for compacting trash within a storage bin comprising
a receiving bin fixed to and in communication with such a storage bin,
a packer panel pivotally mounted on said receiving bin and movable from
a first position in which said receiving bin is open for receiving trash, through
a second position in which said receiving bin is closed so that the trash may not be placed therein, to
a third position in which trash in said receiving bin is pushed toward such a storage means and compacted therein, and
means for selectively moving said panel from said first position to said second position at a relatively high rate of speed and with relatively little force and from said second position to said third position at a progressively reduced rate of speed and with progressively increasing force.

6. A trash compactor comprising
a storage bin,
a receiving bin in communication with said storage bin,
a packer panel pivotally mounted on said receiving bin and moveable from
a first position in which said receiving bin is open to receive trash, through
a second position in which said receiving bin is closed so trash cannot be placed therein, to
a third position in which said packer panel has moved through said receiving bin to push trash therefrom into said storage bin,
reversible drive means for moving said packer panel in both directions between said first, second, and third positions,
first means selectively actuatable by an operator for moving said panel between said first and second positions,
second means selectively actuatable by an operator to initiate movement of said panel from said second position toward said third position,
means for continuing movement of said panel from said second position toward said third position when such movement is so initiated by an operator, and
means for automatically stopping said panel in said third position and reversing the direction of operation of said drive means to move said panel back to said second position.

7. The apparatus of claim 6 including
means for automatically reversing the mode of operation of said drive means when the reaction force exerted by trash being compacted by said packer panel reaches a predetermined size.

8. A trash compacting machine comprising
a hopper for receiving trash,
a packer panel pivotally mounted on said hopper for movement therethrough to push trash in said hopper into a storage means, and
reversible means for driving said panel comprising
torque transmittal means pivotally mounted on said hopper means to which said panel is fixedly attached and operatively coupled to the packer panel for pivoting the packer panel, torque arm means fixedly attached to said torque transmittal means for pivotally driving the torque transmittal means, and means operatively coupled to the torque arm means and pivotable with the torque arm means for pivotally driving said torque arm means with progressively increasing torque and progressively decreasing speed in one direction of movement of said panel to provide a progressive increase in the force imposed by the packer panel on the trash in the bin and with progressively decreasing torque in the opposite direction of movement of said panel.

9. In combination for storing refuse in compacted form, a container for storing the refuse in compacted form, the container having an opening for receiving the refuse, a hopper disposed in contiguous relationship to the container and having a first opening for receiving the refuse and having a second opening communicating with the opening in the container for providing for a transfer of the refuse from the hopper into the container, a packing panel disposed on the container in pivotable relationship to the hopper and pivotable between a first position exposing the first opening in the hopper, a second position closing the first opening in the hopper and a third position near the second opening in the hopper, drive means supported on the hopper in pivotable relationship to the hopper, and driven means supported on the hopper in pivotable relationship to the hopper and operatively coupled to the packing panel and the drive means for producing pivotal movements of the drive means and the driven means in accordance with the operation of the drive means and for providing pivotal movements of the packing panel between the first, second and third positions in accordance with the pivotal movements of the drive means and the driven means.

10. In combination for packing refuse, a container for storing refuse, a hopper for receiving refuse, the hopper being disposed in contiguous relationship to the container, the hopper and the container having communicating openings, the hopper having a second opening displaced from the communicating openings for providing for the introduction of the refuse into the hopper, a packing panel movable between an open position uncovering the second opening for providing for a transfer of the refuse into the hopper, a closed position preventing a transfer of refuse into the hopper through the second opening and an operative position producing a compaction of the refuse in the hopper and a transfer of the compacted refuse into the container, and driving means for providing increases in force on the packing panel at a relatively slow rate during progressive movements of the packing panel from the open position to the closed position and increases in force on the packing panel at a progressively increasing rate during progressive movements of the packing panel from the closed position to the operative position.

11. The combination set forth in claim 10 wherein the driving means drives the packing panel at a speed decreasing at a relatively low rate during progressive movements of the packing panel from the open position to the closed position and drives the packing panel at a speed decreasing at a progressively increasing rate during progressive movements of the packing panel from the closed position to the operative position.

12. In combination for storing refuse in compacted form, a container for storing refuse, a hopper for receiving refuse, the hopper being disposed in contiguous relationship to the container, the hopper and the container having communicating openings, the hopper having a second opening displaced from the communicating openings for providing for the introduction of the refuse into the hopper, a packing panel pivotable between an open position uncovering the second openings for providing for a transfer of the refuse into the hopper, a closed position preventing a transfer of refuse into the hopper through the second opening and an operative position producing a compacting of the refuse in the hopper and a transfer of the compacted refuse into the container, driven means operatively coupled to the packer panel and supported by the container in pivotable relationship to the container and extending into the container for driving the packer panel between the open, closed and operative positions, driving means supported by the container at one side of the container in external relationship to the container and pivotably movable with the driven means for pivotably driving the driven means relative to the packing panel to obtain a pivotal movement of the packer panel between the open, closed and operative positions, and a cover supported by the container and covering the driving means.

13. In combination for storing refuse in compacted form, a container for storing the refuse in compacted form, the container having an opening for receiving the refuse, a hopper disposed in contiguous relationship to the container and having a first opening for receiving the refuse and having a second opening communicating with the opening in the container for providing for a transfer of the refuse from the hopper into the container, a packing panel disposed on the container in pivotable relationship to the hopper and pivotable between a first position exposing the first opening in the hopper, a second position closing the first opening in the hopper and a third position near the second opening in the hopper, means for driving the packing panel between the first, second and third positions, a switch having first and second operative relationships, and means including the switch for operating upon the driving means to obtain a movement of the packing panel from the first position toward the second position upon a first operation of the switch in a first relationship and to obtain a movement of the packing panel from the second position to the third position and then back to the second position upon a second operation of the switch in the first relationship and to obtain a movement of the packing panel from the second position toward the first position upon an operation of the switch in the second relationship.

14. The combination set forth in claim 13, including, the hopper having a lip at its first opening and switching means disposed on the lip and responsive to the exertion of force against the switch for producing a movement of the packing panel to the first position.

15. In combination for storing refuse in compacted form, a container for storing the refuse in compacted form, the container having an opening for receiving the refuse, a hopper disposed in contiguous relationship to the container and having a first opening for receiving the refuse and having a second opening communicating with the opening in the container for providing for a transfer of the refuse from the hopper into the container, a packing panel disposed in the container in pivotable relationship to the hopper and pivotable between a first position exposing the first opening in the hopper, a second position closing the first opening in the hopper and a third position closing the opening between the container and the hopper, and ball screw means supported by the container and operatively coupled to the packing panel for producing a pivotable movement of the packing panel between the first, second and third positions with a progressively increasing force by the packing panel against the refuse in the container as the packing panel moves pivotably between the first, second and third positions.

16. A trash storage apparatus comprising a storage bin for receiving and holding trash, a receiving bin adjacent to and in communication with said storage bin, means for selectively closing said receiving bin and for pushing trash in said receiving bin into said storage bin, said closing and pushing means being movable between a position in which said receiving bin is closed and a position in which said closing and pushing means is positioned at the location in which said receiving bin and said storage bin are in communication, means for driving said closing and pushing means from said bin-closed position to said communication position with gradually increasing force, said driving means comprising a lever arm and means for gradually increasing the length of the lever arm through which a force is imposed on said closing and pushing means as it moves from said bin-closed position, said driving means further including torque lever means, ball gear means pivotally mounted in fixed relationship on said torque lever means, screw gear means pivotally mounted in fixed relation to said receiving apparatus and operatively cooperating with said ball gear means to cause the latter to travel axially along said screw gear means as said screw gear means rotates about its axis, and means for driving said screw gear in opposite directions about its axis.

17. A trash storage apparatus comprising a storage bin for receiving and holding trash, a receiving bin adjacent to and in communication with said storage bin, means for selectively closing said receiving bin and for pushing trash in said receiving bin into said storage bin, said closing and pushing means being movable between a position in which said receiving bin is closed and a position in which said closing and pushing means is positioned at the location in which said receiving bin and said storage bin are in communication, means for driving said closing and pushing means from said bin-closed position to said communication position with gradually increasing force, said closing and pushing means being movable to a fully open position completely out of said receiving bin for allowing trash to be loaded thereinto, and means for preventing said closing and pushing means from being moved from said latter position to said bin-closed position if any material in said receiving bin is not wholly contained therein, said preventing means including means for returning said closing and pushing means to said fully open position if any material in said receiving bin is not wholly container therein.

18. A trash compaction device comprising a trash-receiving bin, compaction panel means mounted on said bin and movable between a first position in which said panel means is elevated above said receiving means to allow placement of trash into said receiving means, a second position in which said receiving bin is closed and no trash can be placed therein, and a third position in which any trash placed into said receiving bin is pushed toward and compacted within a storage means, a storage means located adjacent and in communication with said receiving means to accept trash pushed therefrom by said panel means, means for moving said panel means from said first position to said third position, through said second position, with uniformly increasing force and uniformly decreasing speed, said moving means including means for preventing said panel means from reaching said second position from said first position when trash placed into said bin to be compacted protrudes therefrom, and said preventing means including means for returning said panel means to said first position.

19. A trash compacting machine comprising a hopper for receiving trash, a packer panel pivotally mounted on said hopper for movement therethrough to push trash in said hopper into a storage means, and reversible means for driving said panel comprising torque transmittal means pivotally mounted on said hopper means to which said panel is fixedly attached, torque arm means fixedly attached to said torque transmittal means, and means for driving said torque arm means about the axis of said torque transmittal means with gradually increasing torque in one direction of movement of said panel and gradually decreasing torque in the opposite direction of movement of said panel;

means for moving said torque arm means about the axis of said torque transmittal means comprising ball gear means pivotally mounted near the end of said torque arm means distal from the axis of said torque transmittal means, screw gear means passing through said ball gear means for cooperation therewith to move said ball means axially along said screw gear means, means pivotally mounting one end of said screw gear means in fixed relationship with said hopper for allowing pivoting of the axis of said screw gear means, and motor means fixed relative to said screw gear means for reversibly turning said screw gear in opposite directions about its axis.

20. In combination for storing refuse in compacted form, a container for storing the refuse in compacted form, the container having an opening for receiving the refuse, a hopper disposed in contiguous relationship to the container and having a first opening for receiving the refuse and having a second opening communicating with the opening in the container for providing for a transfer of the refuse from the hopper into the container, a packing panel disposed on the container in pivotable relationship to the hopper and pivotable between a first position exposing the first opening in the hopper, a second position closing the first opening in the hopper and a third position near the second opening in the hopper, and driving means operatively coupled to the packing panel for providing pivotal movements of the packing panel between the first, second and third positions, the driving means including ball screw means including a nut and a screw disposed in cooperative relationship and and the screw being pivotable as the nut moves along the screw and the movement of the nut along the screw producing a pivotable movement of the packing panel between the first, second and third positions.

21. The combination set forth in claim 20 wherein the panel is pivotable on a first fulcrum and the ball screw means is pivotable on a second fulcrum different from the first fulcrum and wherein the distance between the axis of the ball screw means and the first fulcrum progressively increases as the panel is moved from the first position toward the second position and from the second position toward the third position.

22. In combination for storing refuse in compacted form, a container for storing refuse, a hopper for receiving refuse, the hopper being disposed in contiguous relationship to the container, the hopper and the container having communcating openings, the hopper having a second opening displaced from the communicating openings for providing for the introduction of the refuse into the hopper, a packing panel movable between an open position uncovering the second opening for providing for a transfer of the refuse into the hopper, a closed position preventing a a transfer of refuse into the hopper through the second opening and an operative position producing a compacting of the refuse in the hopper and a transfer of the compacted refuse into the container, driven means operatively coupled to the packer panel and supported by the container and extending into the container for driving the packer panel between the open, closed and operative positions, driving means supported by the container at one side of the container in external relationship to the container for driving the driven means to obtain a movement of the packer panel between the open, closed and operative positions, and a cover supporting by the container and covering the driving means, the packer panel is pivotable between the open, closed and operative positions and the driven means is rotary and the driving means pivots relative to the container as it rotates the driven means, the driving means including a motor, a ball screw and a ball nut, a particular one of the ball screw and ball nut being operatively coupled to the motor and the other one of the ball screw and ball nut being operatively coupled to the packing panel.

23. A machine for compacting trash within a storage bin comprising a receiving bin fixed to and in communication with such a storage bin, a packer panel pivotally mounted on said receiving bin and movable from a first position in which said receiving bin is open for receiving trash, through a second position in which said receiving bin is closed so that the trash may not be placed therein, to a third position in which trash in said receiving bin is pushed toward such a storage means and compacted therein, and means for selectively moving said panel from said first position to said second position at a relatively high rate of speed and with relatively little force and from said second position to said third position at a progressively reduced rate of speed and with progressively increasing force, said moving means including bracket means pivotally mounted on said receiving bin, motor means mounted on said bracket means, first gear means mounted on said bracket means and connected to said motor means to be driven thereby, second gear means operatively connected to said panel means and to said first gear means, means for enlarging the lever arm of the force exerted on said panel means by said motor means through said first and second gear means as said panel means is moved from said first position toward said third position, means for sensing when said panel means reaches said third position from said second position and thereupon reversing the direction of rotation of said motor means, means for reversing the direction of rotation of said motor means as said panel means moves from said first position to said second position, and second means for sensing the presence of trash sticking out of said receiving bin and thereupon actuating said reversing means.

24. A trash compactor comprising
a storage bin,
a receiving bin in communication with said storage bin,
a packer panel pivotally mounted on said receiving bin and movable from
a first position in which said receiving bin is open to receive trash, through
a second position in which said receiving bin is closed so trash cannot be placed therein, to
a third position in which said packer panel has moved through said receiving bin to push trash therefrom into said storage bin,
reversible drive means for moving said packer panel in both directions between said first, second and third positions,
first means selectively actuatable by an operator for moving said panel between said first and second positions,
second means selectively actuatable by an operator to initiate movement of said panel from said second position toward said third position,
means for continuing movement of said panel from said second position toward said third position when such movement is so initiated by an operator,
means for automatically stopping said panel in said third position and reversing the direction of operation of said drive means to move said panel back to said second position,
means for gradually increasing the torque exerted on said packer panel as the latter is moved from said first position toward said third position,
said torque increasing means comprising
screw gear means driven by said reversible drive means, and
means operatively connecting said screw gear means to said packer panel and for gradually increasing the distance between the pivot axis of said packer panel and the axis of said screw gear means.

25. A trash compacting machine comprising
trash storage means having an opening,
receiving bin means fixedly locatable in contiguous relationship to the trash storage means and having an inlet including
a lip extending across said inlet and
an outlet through which trash may be moved into the opening in the trash storage means,
packer panel means pivotally mounted on said bin means for rotation about a fulcrum on the bin means and disposed to move in close cooperation with said lip, said panel being movable between
a first position in which said bin is open to receive trash,
a second position in which said panel is closely adjacent said lip to prohibit access to said bin, and
a third position in which said panel is closely adjacent said outlet, and
means for pivotally moving said packer panel means comprising
torque arm means fixed to said packer panel means near the fulcrum thereof and pivotably mounted on the bin with the packer panel means to pivot the packer panel means,
ball gear means pivotally and nonrotatably mounted on said torque arm means adjacent an end thereof distal from the pivot axis of said panel means for movement with the torque lever means,
screw gear means pivotally and rotatably mounted on said bin at a predetermined distance from the pivot axis of said panel means and operatively connected to said ball gear means to be pivoted in accordance with the pivotal movement of the torque arm means, and
motor means pivotably and rotatably mounted on said bin with said screw gear means and fixedly and operatively connected relative to said screw gear means to rotate the latter, and
means for bypassing said actuating means when said panel means is between said second and third positions.

26. In combination for packing refuse,
a container for storing refuse,
a hopper for receiving refuse, the hopper being disposed in contiguous relationship to the container,
the hopper and the container having communicating openings,
the hopper having a second opening displaced from the communicating openings for providing for the introduction of the refuse into the hopper,
a packing panel movable between an open position uncovering the second opening for providing for a transfer of the refuse into the hopper, a closed position preventing a transfer of refuse into the hopper through the second opening and an operative position producing a compaction of the refuse in the hopper and a transfer of the compacted refuse into the container, and
driving means for providing increases in force on the packing panel at a relatively slow rate during progressive movements of the packing panel from the open position to the closed position and increases in force at a progressively increasing rate during progressive movements of the packing panel from the closed position to the operative position,
the driving means driving the packing panel at a speed decreasing at a relatively low rate during progressive movements of the packing panel from the open position to the closed position and driving the packing panel at a speed decreasing at a progressively increasing rate during progressive movements of the packing panel from the closed position to the operative position,
the driving means including a motor and a ball screw arrangement including a screw and a nut threaded on the screw and the motor and the screw being pivotable and the motor driving the screw and the nut traveling along the screw in accordance with the operation of the motor and the nut driving the panel between the open, closed and operative positions as the nut moves along the screw,
the panel being pivotable on a first fulcrum and the distance between the axis of the screw and the first fulcrum progressively increasing as the screw pivots to produce progressively increasing torsional forces on the panel as the panel moves from the open position toward the closed position and from the closed position toward the operative position.

27. In combination for storing refuse in compacted form,
a container for storing refuse,
a hopper for receiving refuse, the hopper being disposed in contiguous relationship to the container, the hopper and the container having communicating openings, the hopper having a second opening displaced from the communicating openings for providing for the introduction of the refuse into the hopper, a packing panel pivotable between an open position uncovering the second opening for providing for a transfer of the refuse into the hopper, a closed position preventing a transfer of refuse into the hopper through the second opening and an operative position producing a compacting of the refuse in the hopper and a transfer of the compacted refuse into the container, driven means operatively coupled to the packer panel and supported by the container in pivotable relationship to the container and extending into the container for driving the packer panel between the open, closed and operative positions, driving means supported by the container at one side of the container in external relationship to the container and pivotably movable with the driven means for pivotably driving the driven means relative to the packing panel to obtain a pivotal movement of the packer panel between the open, closed and operative positions, and a cover supported by the container and covering the driving means, the driven means producing a progressively increasing force on the packing panel as the packing panel pivots between the open, closed and operative positions, the driving means including a motor, a ball screw and a ball nut, a particular one of the ball screw and ball nut being operatively coupled to the motor and the other one of the ball screw and ball nut being operatively coupled to the packing panel, the motor driving the ball screw and the nut driving the panel and the ball screw and the motor being pivotable as the motor drives the ball screw and the nut moving along the ball screw as the motor drives the ball screw and the nut pivoting the panel between the open, closed and operative positions as the nut moves along the ball screw, the panel being pivotable on a first fulcrum and the screw being pivotable at one end on a second fulcrum displaced from the first fulcrum and the distance between the axis of the screw and the first fulcrum increasing as the screw pivots in a direction to drive the panel from the open ppsition toward the closed position and from the closed position toward the operative position.

28. In combination for storing refuse in compacted form, a container for storing the refuse in compacted form, the container having an opening for receiving the refuse, a hopper disposed in contiguous relationship to the container and having a first opening for receiving the refuse and having a second opening communicating with the opening in the container for providing for a transfer of the refuse from the hopper into the container, a packing panel disposed on the container in pivotable relationship to the hopper and pivotable between a first position exposing the first opening in the hopper, a second position closing the first opening in the hopper and a third position near the second opening in the hopper, means for driving the packing panel between the first, second and third positions, a switch having first and second operative relationships, means including the switch for operating upon the driving means to obtain a movement of the packing panel from the first position toward the second position upon a first operation of the switch in a first relationship and to obtain a movement of the packing panel from the second position to the third position and then back go the second position upon a second operation of the switch in the first relationship and to obtain a movement of the packing panel from the second position toward the first position upon an operation of the switch in the second relationship, and means included in the driving means for producing a movement of the panel at a relatively high speed and with a relatively low force from the first position toward the second position and for producing a movement of the panel at a relatively low speed and with a relatively high force from the second position toward the third position, the means included in the driving means providing for a progressive decrease in speed through a limited range and a progressive increase in force through a limited range during the movement of the panel from the first position to the second position and providing for a progressive decrease in speed through an extended range and a progressive increase in force through an extended range during the movement of the panel from the second position to the third position.

29. In combination for storing refuse in compacted form, a container for storing the refuse in compacted form, the container having an opening for receiving the refuse, a hopper disposed in contiguous relationship to the container and having a first opening for receiving the refuse and having a second opening communicating with the opening in the container for providing for a transfer of the refuse from the hopper into the container, a packing panel disposed in the container in pivotable relationship to the hopper and pivotable between a first position exposing the first opening in the hopper, a second position closing the first opening in the hopper and a third position closing the opening between the container and the hopper, and ball screw means supported by the container and operatively coupled to the packing panel for producing a pivotable movement of the packing panel between the first, second and third positions with a progressively increasing force by the packing panel against the refuse in the container as the packing panel moves pivotably between the first, second and third positions, the ball screw means including a ball nut and a screw and a motor for rotating the ball screw and the ball screw being pivotable and the ball nut being operatively coupled to the packing panel for pivotable movement with the panel and being movable along the screw in accordance with such pivotable movement and the screw being pivotable in accordance with the movement of the ball nut along the screw, the screw being pivotable on a fulcrum disposed at one end of the screw and the packing panel being pivotable on a first fulcrum displaced from the packing panel and the screw being disposed relative to the first fulcrum for progressive displacement of the axis of the screw relative to the first fulcrum as the packing panel pivots progressively from the first position to the second position and from the second position to the third position.

30. The combination set forth in claim 29, including, the first fulcrum being disposed near the top of the container and the ball screw means and the motor being disposed in a separate compartment at one lateral end of the container.

* * * * *